United States Patent [19]

Keuver

[11] 4,048,724

[45] Sept. 20, 1977

[54] ELLIPSOGRAPH

[76] Inventor: Paul H. Keuver, 8357 Woodlawn, San Gabriel, Calif. 91775

[21] Appl. No.: 675,928

[22] Filed: Apr. 12, 1976

[51] Int. Cl.[2] ..... B43L 11/04

[52] U.S. Cl. ..... 33/31; 33/30 R

[58] Field of Search ..... 33/30 R, 30 D, 30 G, 33/31

[56] References Cited

U.S. PATENT DOCUMENTS

| | | | |
|---|---|---|---|
| 2,477,203 | 7/1949 | Rabinowitz | 33/30 D |
| 2,992,485 | 7/1961 | Karlsberg | 33/31 |
| 3,422,538 | 1/1969 | Panissidi | 33/30 A |

FOREIGN PATENT DOCUMENTS

| | | | |
|---|---|---|---|
| 1,187,022 | 2/1965 | Germany | 33/31 |

*Primary Examiner*—Richard E. Aegerter
*Assistant Examiner*—John W. Shepperd
*Attorney, Agent, or Firm*—Victor C. Muller

[57] ABSTRACT

An ellipsograph characterized by a pair of rectilinearly slideable members disposed in 90° crossing relationship and adjustable radii crankpins for moving same, forming a pair of Scotch yokes, and a stylus carrying member slideably engaging both members in the locus of their crossing, adapted to resolve the rectilinear movements of the members into elliptical movement.

9 Claims, 4 Drawing Figures

ELLIPSOGRAPH

BACKGROUND OF THE INVENTION

The art of ellipsographs is well developed as evidenced by patents too numerous to cite for any practical purpose herein. Many, if not most, failed to reach commercial markets due to their complicated constructions and attendant costs to commercially succeed. The need for simplification and relative low cost was early recognized. As exemplified by U.S. Pat. No. 1,644,205 (1927) to Rettedal et al. While this construction satisfied the criteria, just referred to, it was capable of generating only semi-ellipses, requiring two settings to generate a complete ellipse. As the art developed, devices were devised to generate complete elipses and within the envelope of the device, as distinguished from the Rettedal patent, as exemplified by U.S. Pat. No. 2,039,584 (1936) to Dixon. A later design of this general concept is exemplified by U.S. Pat. No. 2,670,540 (1954) to Randles. In the two patents just referred to, an ellipse is generated within the outline or envelope of the apparatus, the components of motion being resolved into elliptical motion of a stylus carried at the end of a cantilivered arm. Of these two patents, the patent to Dixon probably most resembles the present invention. The present invention differs, however, in material structural respects as will subsequently appear.

SUMMARY OF THE INVENTION

Apparatus characterized by a square base plate having a central aperture therein, a pair of sliders rectilinerally movable normal to each other in crossing relationship, an ellipse generating member slideably engaging both members at their locus of crossing, a pair of radially adjustable crankpins for moving the members, and disposed on a diameter of a crankpin actuating member rotatable about an axis through which the diameter passes. The crankpin actuating member may be rotated by a journaled ring gear, rotatable by a meshing pinion and crank affixed thereto. Ellipses of sizes between a point and the size of the central aperture may be generated therein. The ellipse generating member may carry a pen or pencil for drawing ellipses on paper, a torch cutting tip for cutting ellipses from metal plate, or other device for sensing the path of movement of the ellipse generating member.

In accordance with the foregoing, one of the objects of the invention, in one of its broader respects, is to mechanically couple a pair of sliders at the locus of their crossing, to an ellipse generating member which slideably engages both sliders and resolves their respective rectilinear movements into elliptical movement.

Another object is to provide a driving member, journaled for rotation, which carries a pair of crankpins on its diameter, the crankpins being radially adjustable and rotationally and slideably engageable with their respective sliders.

Another object is to provide a ring-gear for rotating the driving member, aforesaid.

A further object is to orient the driving member and sliders in specific orientation relative to each other.

A still further object is to provide apparatus of variable size which may be employed for drafting, scribing, flame cutting or other use requiring a generated ellipse.

Still further objects, advantages, and salient features will become more apparent from the detailed description to follow, the appended claims, and the accompanying drawing, to now be briefly described.

DETAILED DESCRIPTION OF PREFERRED EMBODIMENTS

Figure 1:
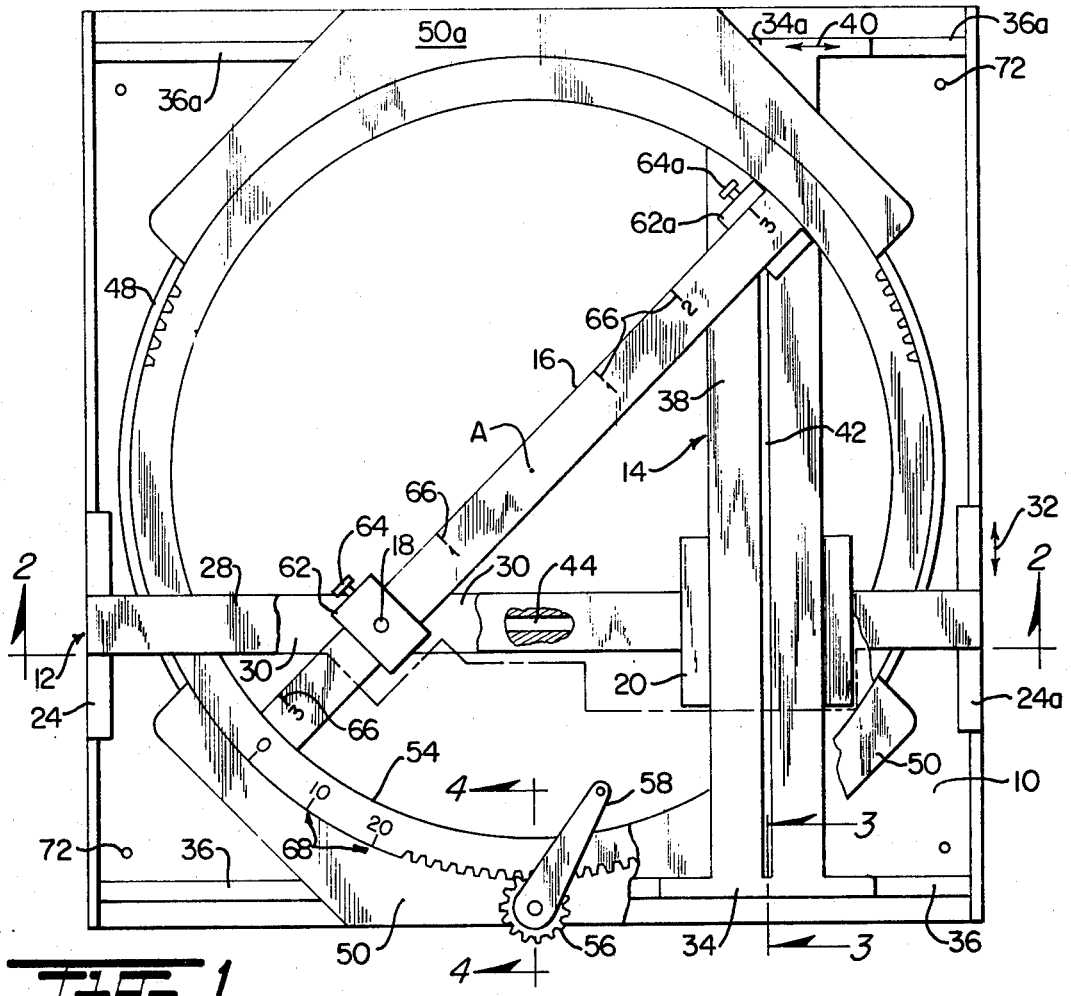
FIG. 1 is a top plan, portions being broken away.

Referring now to the drawing in detail, the subject of the invention comprises, in general, a base plate or support means 10, a first slider 12, a second slider 14, a rotatable bar or actuating members 16 which carries a pair of radially adjustable crankpins or pivots **18,18*a*, and a crosshead 20** which slideably engages both sliders.

Base plate 10 is rectangular, such as square, and contains a central circular aperture 22 therein, the periphery of which defines an envelope in which ellipses of various major and minor axes may be generated.

Figure 2:
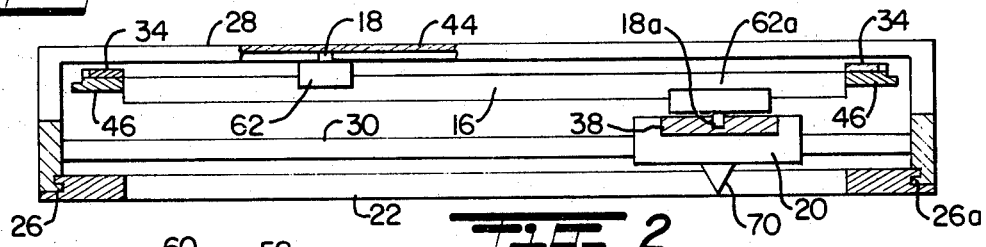
FIG. 2 is a section taken on line 2—2, FIG. 1.

The first slider 12 comprises a pair of identical blocks **24,24*a* guided for rectilinear movement along the left and right edges of the base plate by machine guides 26,26*a*, best shown in FIG. 2, which also secure same to the base plate against movement perpendicular to their plane of movement. A bar 28 extends between the tops of the blocks and another bar 30, directly therebelow, extends between same, the two blocks and two bars forming an integral unit which is rectilinearly slideable in a plane and in the direction of arrow 32**.

Figure 4:
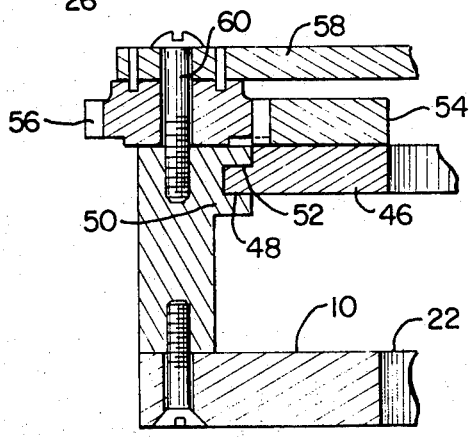
FIG. 4 is an enlarged section taken on line 4—4, FIG. 1.
Figure 3:
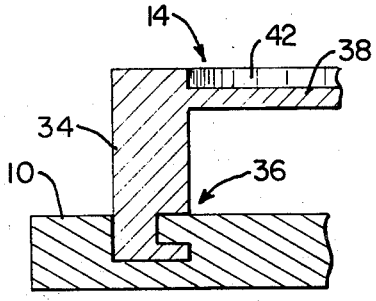
FIG. 3 is an enlarged section taken on line 3—3, FIG. 1.

The second slider 14 comprises similar blocks **34,34*a* slideable in like machine guides 36,36*a*, one of which is best shown in FIG. 3, and a bar 38 extends between the tops thereof, the blocks and bar forming a second integral unit which is slideable in a plane and in the direction of arrow 40. A groove 42 in the upper face of bar 38 extends centrally along its length and a like groove 44 in the lower face of bar 28 extends centrally along its length, the purpose of which will subsequently appear. As best shown in FIGS. 1 and 4, rotatable bar 16 is secured at its ends to a ring 46 having a peripheral flange 48 journaled for rotation in arcuate bearings 50,50*a*, each of which is provided with an arcuate groove 52, which rotatably supports flange 48. A ring gear 54 is affixed to the top of ring 46 which may be rotated by a meshing pinion 56 and crank 58, journaled for rotation on a pin 60. As will be apparent, rotation of the crank causes bar 16** to rotate about its central axis A.

Bar 16 is provided with a pair of u-shaped blocks or crankpin carries **62,62*a* which are radially slideable along same and locked thereto in desired positions in any suitable manner, such as by thumb screws 64,64*a*. The blocks are identical but oriented 180° relative to each other so that the crankpins 18,18*a* rotatably and slideably engage grooves 44,42 in bars 28,38**, respectively. The blocks may be disposed on opposite sides of axis A, as shown, or on the same side (not shown), and produce the same motions to the sliders.

Bar 16 is provided with graduations 66 for setting the radial distance of crankpins **18,18*a* from the axis of rotation A, the two distances being a measure of the length of the two axis of the ellipse. In the event they are the same length, the ellipse becomes a circle. Also, angular graduations 68 are provided on ring gear 54** around its periphery, a portion being shown, so that a partial angular generation of an ellipse may be attained.

Since u-shaped blocks 62,62a are inverted relative to each other, as previously described, and since they are adjustable along spaced planes, they may be adjusted to overlapping positions where their crankpins are aligned on axis A in which case the curve generated is a point. Slight outward movement to different radii will then generate a very small ellipse and further radial movement will generate larger ellipses, the largest being limited to the circular envelope formed by aperture 22 in base 10.

As illustrated, the generating point or tip of stylus 70, carried by cross-head or ellipse generating member 20, is disposed at the intersection of the center lines of bars 28, 30 and 38. Since this may take various forms, depending upon the use of the device, this has been illustrated in general form. For example, if used as a drafting instrument, the stylus may be a pencil or pen, preferably spring loaded, so that it will be urged downwardly with slight pressure onto paper on which the base plate lies and is affixed in any suitable manner to maintain it against movement. For this purpose, for example, holes 72 may be provided for thumbpins which secure it to a drafting board. If employed for cutting steel end or baffle plates of large elliptical tanks, such as carried by trucks or railway cars, the device may be suitably enlarged and stylus 70 may take the form of a cutting torch tip supplied with oxygen and accetylene through flexible hoses. For this purpose the base may be supported by casters or raising block to place the cutting tip at a desired position relative to the steel plate to be cut. In another application, the position of the stylus could be electronically sensed and the coordinates of movement electrically transmitted to a remote locus.

Various other modifications of the exemplary form of invention, as specifically described, will also become apparent. For example, the base 10 may be rectangular, rather than square, and have an oval or elliptical aperture 22 therein; the base member may be in the form of a suitable framework, preferably supported by casters or the like, if large; ring 46 may be journaled about its entire periphery, rather than at segmental portions thereof; anti-friction bearings may be provided between movable parts, ring 46 may be frictionally driven, rather than by gears; a disc may be employed, rather than bar 16; and means may be provided for selectively raising and lowering stylus 70. Also, while a Scotch yoke mechanism has been disclosed in its simplest form, including a slot and a crankpin rectilinearly movable therealong, it will be apparent that other Scotch yoke mechanisms may be employed; for example, a block, or the like, may slideably engage the slideable member by suitable machine guides or by one or more anti-friction linear bearings, and the crankpin pivotally connected to the block, which constitutes a mechanical equivalent of the construction illustrated.

What is claimed is:

1. An ellipsograph comprising;

a. a support member adapted to be disposed adjacent a surface on which an ellipse is to be generated, b. a crank pin actuating member and means for supporting same on the support member for rotation about a fixed axis, said actuating member defining a rotatable reference axis intersecting the fixed axis normal thereto, c. first and second rotatable crank pins and means for individually adjusting same to desired fixed positions along said reference axis of the actuating member, d. a first slide member and means for slideably connecting same to the support member for rectilinear movement relative thereto, e. means for operatively connecting said first crank pin to said first slide member for rectilinear movement therealong, the construction being such that rotation of said first crank pin translates rectilinear movement to said first slide member, f. a second slide member and means for slideably connecting same to the support member for rectilinear movement relative thereto but in a direction normal to the direction of movement of the first slide member, g. means for operatively connecting said second crankpin to said second slide member for rectilinear movement therealong, the construction being such that rotation of said second crankpin translates rectilinear movement to said second slide member, and h. an ellipse generating member and means for operatively connecting same to said first and second slide members for slideable rectilinear movement relative to both, the construction being such that the combined rectilinear movements of the first and second slide members is resolved into elliptical motion imparted to the ellipse generating member.

2. Apparatus in accordance with claim 1 wherein the first slide member is operatively connected to the actuating member at a position thereabove, and the second slide member is operatively connected to the actuating member at a position therebelow, the construction being such that the actuating member may rotate between its two operative connections to the two slide members.

3. Apparatus in accordance with claim 2 wherein each slide member is supported for rectilinear movement at ends thereof and adjacent opposite edges of the support member.

4. Apparatus in accordance with claim 3 wherein the actuating member comprises a bar supported for rotation by its ends, the bar extending across its axis or rotation.

5. Apparatus in accordance with claim 1 wherein said support member is rectangular, such as square, and is provided with an aperture therethrough defining an area within which an ellipse of maximum major axis may be generated.

6. Apparatus in accordance with claim 1 wherein the actuating member is provided with a circular gear, having teeth about its periphery, a relatively small rotatable pinion gear meshing with same, and means for rotating the pinion gear.

7. Apparatus in accordance with claim 1 wherein the actuating member comprises a bar supported for rotation by its ends, the bar extending across its axis of rotation.

8. Apparatus in accordance with claim 7 including a pair of crankpin carriers slideably adjustable along the bar and affixable thereto at desired positions therealong, each crankpin being affixed to a carrier.

9. Apparatus in accordance with claim 1 wherein each slide member is supported for rectilinear movement at ends thereof and adjacent opposite edges of the support member.

* * * * *